US008225760B2

(12) United States Patent
Sato et al.

(10) Patent No.: US 8,225,760 B2
(45) Date of Patent: Jul. 24, 2012

(54) VALVE MOTION FOR AN INTERNAL COMBUSTION ENGINE

(75) Inventors: Toshiyuki Sato, Saitama (JP); Masaki Cho, Saitama (JP); Takahiro Imafuku, Saitama (JP)

(73) Assignee: Honda Motor Co., Ltd., Tokyo (JP)

( * ) Notice: Subject to any disclaimer, the term of this patent is extended or adjusted under 35 U.S.C. 154(b) by 317 days.

(21) Appl. No.: 12/722,243

(22) Filed: Mar. 11, 2010

(65) Prior Publication Data

US 2010/0242882 A1 Sep. 30, 2010

(30) Foreign Application Priority Data

Mar. 27, 2009 (JP) ..... 2009-080537

(51) Int. Cl.
*F01L 1/34* (2006.01)

(52) U.S. Cl. ..... 123/90.16; 123/90.39; 123/90.44; 74/559; 74/569

(58) Field of Classification Search ..... 123/90.16, 123/90.39, 90.44; 74/559, 567, 569
See application file for complete search history.

(56) References Cited

U.S. PATENT DOCUMENTS 7,779,798 B2 * 8/2010 Weiss ..... 123/90.16

FOREIGN PATENT DOCUMENTS

JP 2005-207254 A 8/2005

* cited by examiner

*Primary Examiner* — Ching Chang
(74) *Attorney, Agent, or Firm* — Birch, Stewart, Kolasch & Birch, LLP

(57) ABSTRACT

A valve motion for an internal combustion engine which suppresses the height of the internal combustion engine low. In a valve motion for an internal combustion engine, a driving mechanism includes a ball screw disposed over an intake side camshaft and an exhaust side camshaft and having threaded portions provided thereon which are threaded in different directions from each other on the intake side and the exhaust side. Sliders are individually provided on the intake side and exhaust side and movable on the ball screw with connecting link members provided between the sliders and a holder member.

20 Claims, 7 Drawing Sheets

VALVE MOTION FOR AN INTERNAL COMBUSTION ENGINE

CROSS-REFERENCE TO RELATED APPLICATIONS

The present application claims priority under 35 USC 119 to Japanese Patent Application No. 2009-080537 filed on Mar. 27, 2009 the entire contents of which are hereby incorporated by reference.

BACKGROUND OF THE INVENTION

1. Field of the Invention

This invention relates to a valve motion for an internal combustion engine wherein the valve operation characteristic of an engine valve can be changed.

2. Description of Background Art

A valve motion for an internal combustion engine is known wherein a camshaft rotates in synchronism with the rotation of the internal combustion engine with a driving cam that rotates integrally with the camshaft. A valve motion cam makes relative rotation to the camshaft to open and close an engine valve. A link mechanism for transmitting a valve driving force of the driving cam to the valve motion cam is provided. A holder member supports a fulcrum of the link mechanism thereon and is rockable around the camshaft. A driving mechanism for rocking the holder member to vary the position of the fulcrum of the link mechanism is provided wherein a valve operation characteristic in accordance with which the engine valve opening and closing can be changed by the rocked position of the fulcrum of the link mechanism. This driving mechanism includes a slider for rocking the holder member and a feed screw shaft extending in an upward and downward direction of the internal combustion engine for moving the slider and for moving the slider on the feed screw shaft to rock the holder member. See, for example, Japanese Patent Laid-Open No. 2005-207254.

However, with the conventional configuration described above, since the feed screw shaft for moving the slider extends in an upward and downward direction of the internal combustion engine, the height of the internal combustion engine is increased. Thus, it is difficult to incorporate the valve motion in a small-sized vehicle such as a motorcycle.

SUMMARY AND OBJECTS OF THE INVENTION

It is an object of an embodiment of the present invention to provide a valve motion for an internal combustion engine which eliminates the problems of the prior art described above and suppresses the height of the internal combustion engine to be low.

According to an embodiment of the present invention, a valve motion for an internal combustion engine includes a camshaft for rotating in synchronism with the rotation of the internal combustion engine within a driving cam which rotates integrally with the camshaft. A valve motion cam provides a relative rotation to the camshaft to open and close an engine valve with a link mechanism being provided for transmitting a valve driving force of the driving cam to the valve motion cam. A holder member supports a fulcrum of the link mechanism thereon and is rockable around the camshaft with a driving mechanism for rocking the holder member to vary the position of the fulcrum of the link mechanism. A valve operation in accordance with which the engine valve opens and closes can be changed by the rocked position of the fulcrum of the link mechanism wherein the driving mechanism includes a ball screw disposed over the intake side camshaft and the exhaust side camshaft and having threaded portions provided thereon which are threaded in different directions from each other on the intake side and the exhaust side, sliders individually provided on the intake side and exhaust side and movable on the ball screw, and connecting link members provided between the sliders and the holder member.

With the configuration described above, since the ball screw for moving the sliders is disposed over the intake side camshaft and the exhaust side camshaft, the height of the internal combustion engine can be suppressed low in comparison with an alternative case wherein the ball screw extends in an upward and downward direction of the internal combustion engine. Further, since the threaded portions having directions different from each other on the intake side and the exhaust side are provided on the ball screw and the sliders movable on the ball screw are provided on the intake side and the exhaust side of the ball screw, even if the distance between the intake and exhaust camshafts where the valve motion is formed as that of the DOHC type increases, the length of the connecting link members for connecting the sliders and the holder can be suppressed short.

In the valve motion for an internal combustion engine described above, the threaded portions of the ball screw may be formed at positions sandwiched by the intake side driving cam and the exhaust side driving cam and the connecting link member may include two link members connected for pivotal motion, and the connecting portions of the two link members may be positioned on the cylinder center side with respect to the slider side connecting portion and the holder side connecting portion.

With the configuration described above, since the threaded portions of the ball screw are formed at positions sandwiched between the intake side driving cam and the exhaust side driving cam, the sliders move on the ball screw between the intake side driving cam and the exhaust side driving cam. Consequently, the width of a cylinder head can be reduced. Further, since the connecting link member includes the two link members connected for pivotal motion to each other and the connecting portions of the two link members are positioned on the cylinder center side with respect to the slider side connecting portion and the holder side connecting portion, it is possible to dispose the ball screw and the holders more closely to each other. Therefore, the height of the cylinder head can be reduced.

In the valve motion for the internal combustion engine, the connecting link member may be connected at one of pivots thereof by an eccentric pin.

With the configuration described above, since production errors of parts are absorbed by the eccentric pin, positional adjustment of the parts can be carried out readily.

According to an embodiment of the present invention, since the ball screw for moving the sliders is disposed over the intake side camshaft and the exhaust side camshaft, the height of the internal combustion engine can be suppressed low in comparison with an alternative case wherein the ball screw extends in an upward and downward direction of the internal combustion engine. Further, since the threaded portions having directions different from each other on the intake side and the exhaust side are provided on the ball screw and the sliders movable on the ball screw are provided on the intake side and the exhaust side of the ball screw, even if the distance between the intake and exhaust camshafts where the valve motion is formed as that of the DOHC type increases, the length of the connecting link members for connecting the sliders and the holder can be suppressed short. As a result, the holders can be pivoted without narrowing the range of pivotal motion thereof.

Further, since the threaded portions of the ball screw are formed at positions sandwiched between the intake side driving cam and the exhaust side driving cam, the sliders move on the ball screw between the intake side driving cam and the exhaust side driving cam. Consequently, the width of a cylinder head can be reduced. Further, since the connecting link member includes the two link members connected for pivotal motion to each other and the connecting portions of the two link members are positioned on the cylinder center side with respect to the slider side connecting portion and the holder side connecting portion, it is possible to dispose the ball screw and the holders more closely to each other. Therefore, the height of the cylinder head can be reduced.

Further, since the connecting link member is connected at one of pivots thereof by an eccentric pin, production errors of parts are absorbed by the eccentric pin. Consequently, the positional adjustment of the parts can be carried out readily.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The present invention will become more fully understood from the detailed description given hereinbelow and the accompanying drawings which are given by way of illustration only, and thus are not limitative of the present invention, and wherein.

DESCRIPTION OF THE PREFERRED EMBODIMENTS

In the following, a preferred embodiment of the present invention is described with reference to the drawings. It is to be noted that description of directions such as forward, backward, leftward, rightward, upward and downward directions is based on those with regard the vehicle body.

Figure 1:
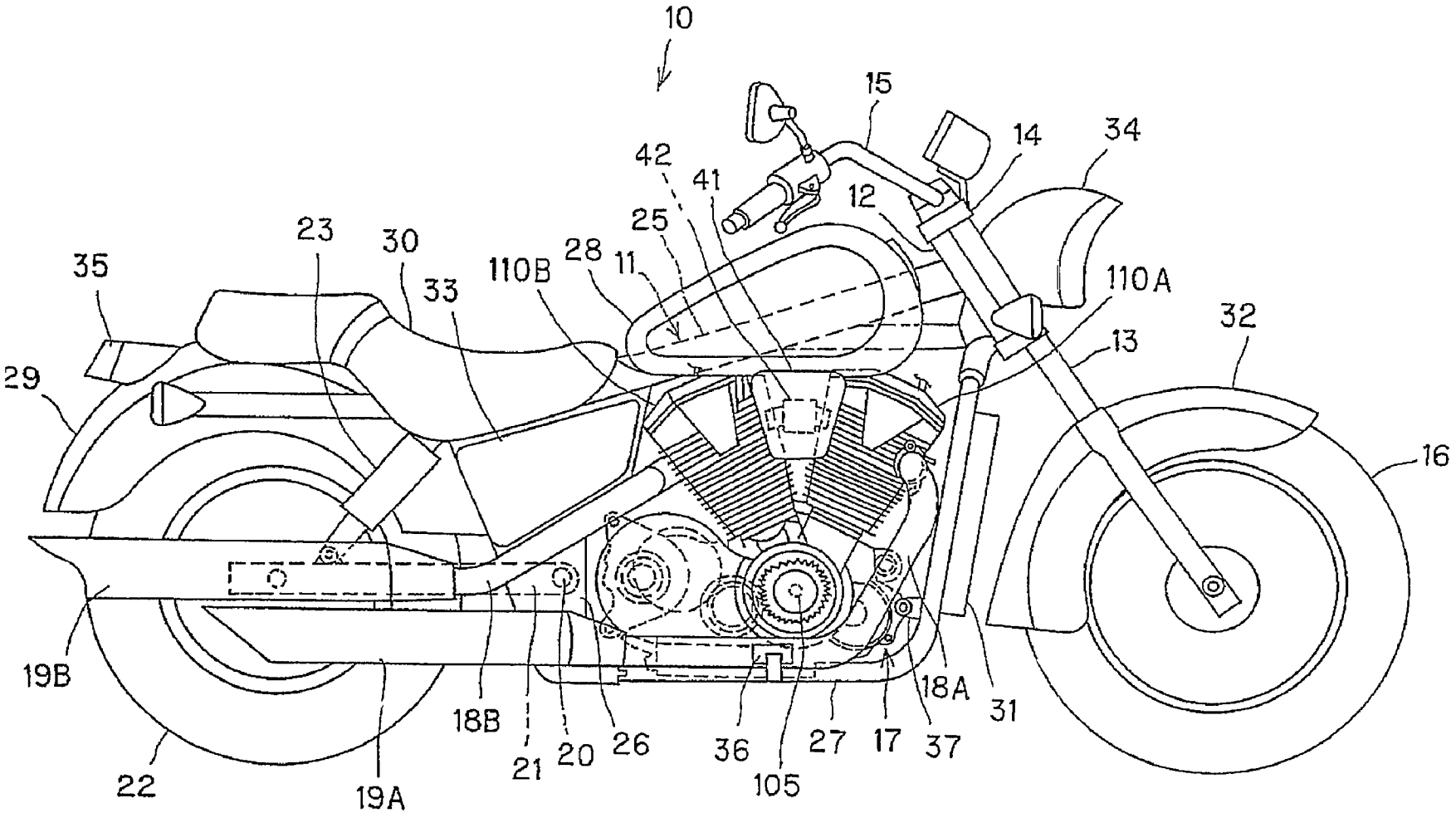
FIG. 1 is a side elevational view showing a motorcycle in which a valve motion according to an embodiment of the present invention is incorporated.

FIG. 1 is a side elevational view showing a motorcycle to which a valve motion according to an embodiment of the present invention is applied. The motorcycle 10 includes a vehicle body frame 11, a pair of left and right front forks 13 supported for pivotal motion on a head pipe 12 attached to a front end portion of the vehicle body frame 11, a handle bar 15 for steering attached to a top bridge 14 which supports an upper end portion of the front forks 13, a front wheel 16 supported for rotation on the front forks 13, an engine 17 as an internal combustion engine supported on the vehicle body frame 11, exhaust mufflers 19A and 19B connected to the engine 17 through exhaust pipes 18A and 18B, a swing arm 21 supported for upward and downward rocking motion on a pivot 20 at a rear lower portion of the vehicle body frame 11, and a rear wheel 22 supported for rotation at a rear end portion of the swing arm 21. A rear shock absorber 23 is disposed between the swing arm 21 and the vehicle body frame 11.

The vehicle body frame 11 includes a main frame 25 extending rearwardly and downwardly from the head pipe 12, a pair of left and right pivot plates (also called center frames) 26 connected to a rear portion of the main frame 25, and a down tube 27 extending downwardly from the head pipe 12 and bent and extending until it is connected to the pivot plates 26. A fuel tank 28 is supported in such a manner so as to stretch over the main frame 25 with a rear portion of the main frame 25 extending to a position above the rear wheel 22. A rear fender 29 is supported at the rear portion of the main frame 25, and a seat 30 is supported between a position above the rear fender 29 and the fuel tank 28. In FIG. 1, a radiator 31 is supported on the down tube 27 with a front fender 32, a side cover 33, a headlamp 34, a tail lamp 35, and a rider's step 36.

In a space defined by the main frame 25, pivot plates 26 and down tube 27, the engine 17 is supported. The engine 17 is a longitudinal V-type 2-cylinder water-cooled 4-cycle engine wherein cylinders are disposed in front and rear banks in a V-shape. The engine 17 is supported on the vehicle body frame 11 through a plurality of engine brackets 37 (only one of them is shown in FIG. 1) such that a crankshaft 105 is directed in a leftward and rightward horizontal direction with respect to the vehicle body. Power of the engine 17 is transmitted to the rear wheel 22 through a drive shaft (not shown) disposed on the left side of the rear wheel 22.

The engine 17 is formed such that the included angle (also called banking angle) between the front bank 110A and the rear bank 110B formed by the cylinders is an angle (for example, 52 degrees) smaller than 90 degrees. Valve motions of the banks 110A and 110B are formed as those of the 4-valve double overhead camshaft (DOHC) type.

In the V-shaped space defined by the front bank 110A and the rear bank 110B, an air cleaner 41 and a throttle body 42 which form an engine intake system are disposed. The throttle body 42 supplies air cleaned by the air cleaner 41 to the front bank 110A and the rear bank 110B. To the banks 110A and 110B, exhaust pipes 18A and 18B which form an engine exhaust system are connected. The exhaust pipes 18A and 18B pass on the right side of the vehicle body, and exhaust mufflers 19A and 19B are connected to rear ends of the exhaust pipes 18A and 18B, respectively, so that exhaust gas is exhausted through the exhaust pipes 18A and 18B and the exhaust mufflers 19A and 19B.

Figure 2:
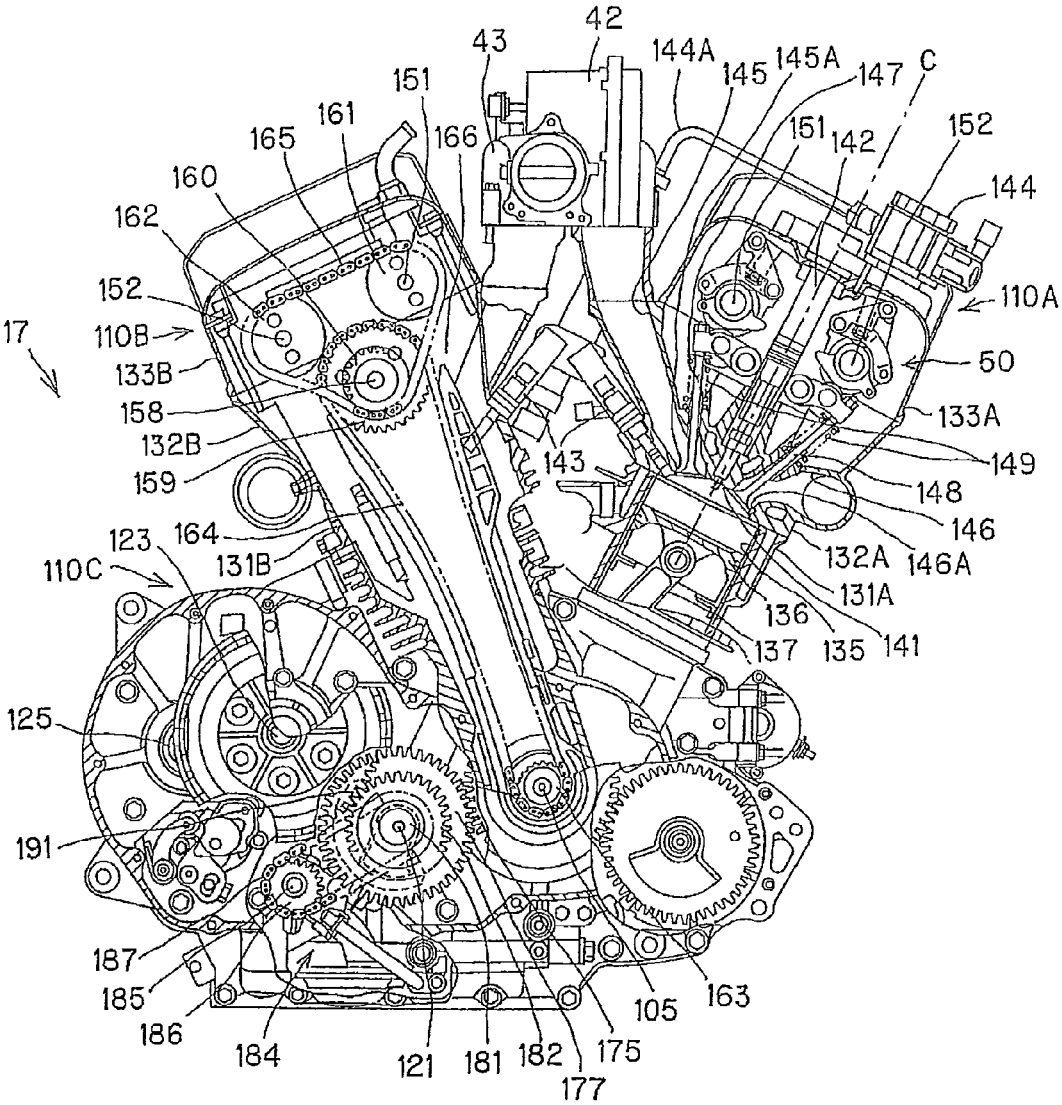
FIG. 2 is a side elevational view showing an internal structure of an engine.
Figure 3:
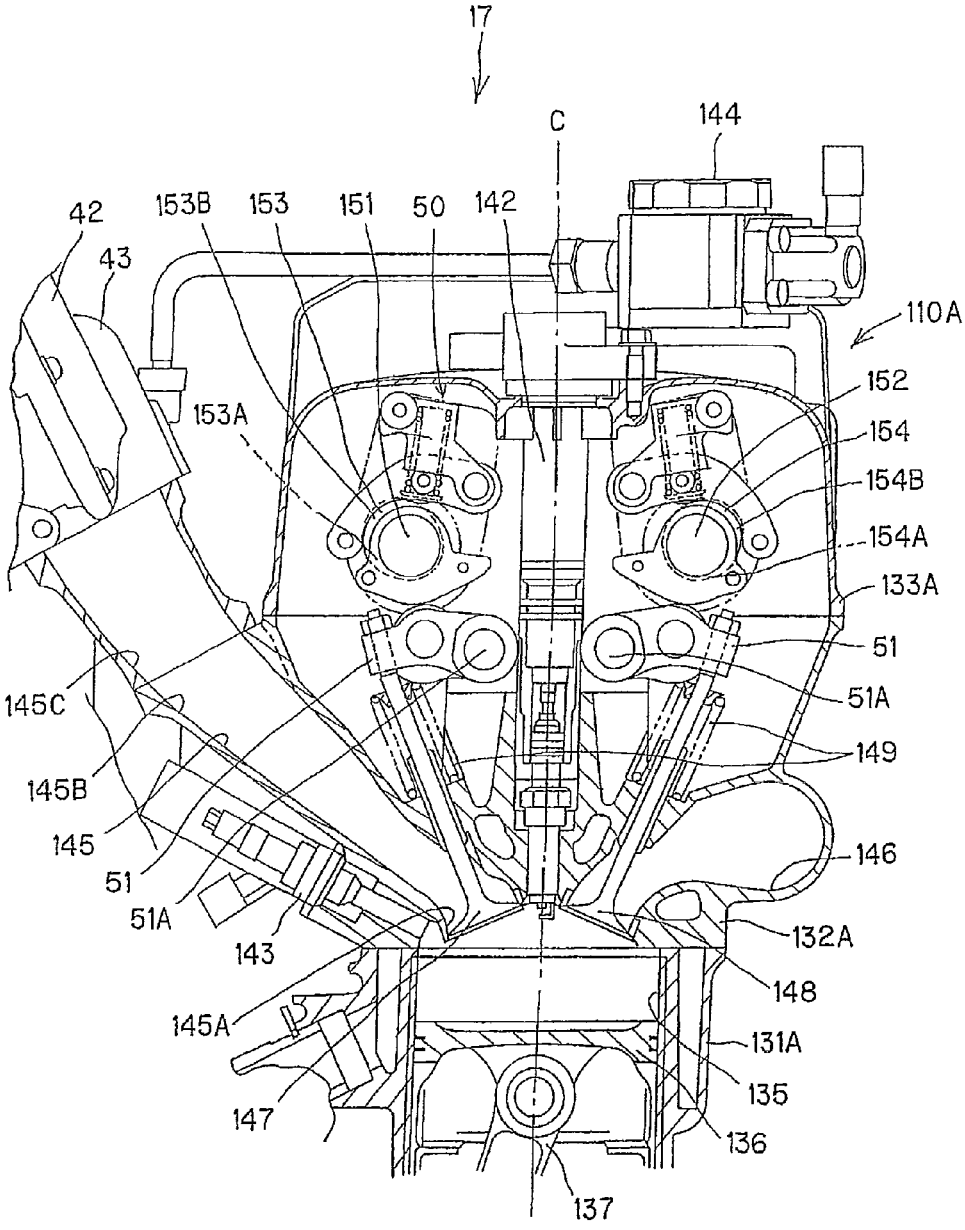
FIG. 3 is a side elevational view showing an internal structure of a front bank of FIG. 2 in an enlarged scale.

FIG. 2 is a view of an internal structure of the engine 17 as viewed from the side, and FIG. 3 is a view showing an internal structure of the front bank 110A of FIG. 2 in an enlarged scale.

Referring to FIG. 2, the front bank 110A and the rear bank 110B of the engine 17 have the same structure. In FIG. 2, the front bank 110A is shown in regard to peripheral elements of a piston and the rear bank 110B is shown in regard to peripheral elements of a cam chain. Further, as illustrated in FIG. 2, an intermediate shaft 121 (rear side balancer shaft), a main shaft 123, and a countershaft 125 are provided. The shafts 121, 123 and 125 including the crankshaft 105 are disposed in parallel to each other and in a displaced relationship from each other in the forward and backward direction and the upward and downward direction of the vehicle body. In a crankcase 110C which supports the shafts mentioned, a gear transmission for transmitting rotation of the crankshaft 105 to the intermediate shaft 121, main shaft 123 and countershaft 125 in order is formed.

As shown in FIG. 2, a front side cylinder block 131A and a rear side cylinder block 131B are disposed forwardly and backwardly of the vehicle body on, respectively, an upper face of the crankcase 110C of the engine 17 such that they define a predetermined included angle therebetween, and a front side cylinder head 132A and a rear side cylinder head 132B are coupled to the upper face of the cylinder blocks 131A and 131B, respectively. Further, head covers 133A and 133B are mounted on the upper face of the cylinder heads 132A and 132B to form the banks 110A and 110B, respectively.

In the cylinder blocks 131A and 131B, cylinder bores 135 are formed, and in each of the cylinder bores 135, a piston 136 is inserted for sliding movement. The pistons 136 are connected to the crankshaft 105 through connecting rods 137.

On a lower face of each of the cylinder heads 132A and 132B, a combustion concave portion 141 which forms a top face of a combustion chamber formed above the piston 136 is formed, and an ignition plug 142 is disposed such that an end thereof faces each of the combustion concave portions 141. The ignition plug 142 is provided substantially coaxially with a cylinder axial line (cylinder center) C.

The engine 17 is a cylinder injection type engine wherein fuel is injected directly into each combustion chamber from an injector 143 provided in each combustion concave portion 141. Each injector 143 is inserted from a V-bank inner side face of each of the cylinder heads 132A and 132B and is disposed such that an end thereof faces the combustion concave portion 141. The injector 143 is attached in a state wherein it is laid with respect to the cylinder axial line C.

A fuel pump 144 is provided at an upper portion of the front side cylinder head 132A, and fuel is supplied from the fuel pump 144 into each injector 143 through a fuel pipe 144A.

In each of the cylinder heads 132A and 132B, an intake port 145 communicating at a pair of openings 145A with each combustion concave portion 141 and an exhaust port 146 communicating at a pair of openings 146A with each combustion concave portion 141 are formed. The intake port 145 is disposed between the cylinder axial line C and the injector 143.

As shown in FIGS. 2 and 3, each of the intake ports 145 includes a lower intake port 145B provided integrally with the cylinder head 132A or 132B, and an upper intake port 145C provided separately from the cylinder head 132A or 132B. The upper intake port 145C is attached to the lower intake port 145B at a different angle so as to be directed such that it approaches the head cover 133A or 133B rather than the lower intake port 145B.

The intake ports 145 join together at an intake chamber 43, and this intake chamber 43 is connected to the throttle body 42. For the throttle body 42, a TBW (Throttle By Wire) which varies the sectional area of a throttle valve by driving of an actuator is adopted. The exhaust port 146 of the front side cylinder head 132A is connected to the exhaust pipe 18A (refer to FIG. 1), and the exhaust port 146 of the rear side cylinder head 132B is connected to the exhaust pipe 18B (refer to FIG. 1).

In the cylinder heads 132A and 132B, a pair of intake valves (engine valves) 147 for opening and closing the openings 145A of the intake port 145 and a pair of exhaust valves (engine valves) 148 for opening and closing the openings 146A of the exhaust port 146 are disposed. The intake valves 147 and the exhaust valves 148 are biased by valve springs 149, 149 in a direction in which the ports are closed. The intake valves 147 and 148 are driven by valve motions 50 whose valve operation characteristics such as the opening and closing timings, lift amount and so forth can be varied. The valve motions 50 are supported for rotation on the cylinder heads 132A and 132B and includes camshafts (cam shafts) 151 and 152 on the intake side and exhaust side which rotate in synchronism with rotation of the engine 17.

Intake cams (driving cams) 153 are formed integrally on the camshaft 151. Each of the intake cams 153 has a base circle portion 153A which forms a circular cam face and a cam lobe portion 153B which projects to the outer circumference side from the base circle portion 153A to form a mountain-shaped cam surface. Meanwhile, exhaust cams (driving cams) 154 are formed integrally on the camshaft 152. Each of the exhaust cams 154 has a base circle portion 154A which forms a circular cam face and a cam lobe portion 154B which projects to the outer circumference side from the base circle portion 154A to form a mountain-shaped cam surface.

As shown in FIG. 2, an intermediate shaft 158 is supported for rotation on one end side in the widthwise direction of each of the cylinder heads 132A and 132B, and intermediate sprocket wheels 159 and 160 are secured to the intermediate shaft 158. A driven sprocket wheel 161 is secured to the one end side of the camshaft 151, and another driven sprocket wheel 162 is secured to the one end side of the camshaft 152. Driving sprocket wheels 163 are secured to the opposite end sides of the crankshaft 105. A first cam chain 164 is wrapped around the sprocket wheels 159 and 163, and a second cam chain 165 is wrapped around the sprocket wheels 160 to 162. The sprocket wheels 159 to 163 and the cam chains 164 and 165 are accommodated in a cam chain chamber 166 formed on the one end side of the banks 110A and 110B.

The reduction ratio from the driving sprocket wheel 163 to the driven sprocket wheels 161 and 162 is set to 2. If the crankshaft 105 rotates, then the driving sprocket wheel 163 rotates integrally with the crankshaft 105, and the driven sprocket wheels 161 and 162 rotate at a speed equal to one half that of the crankshaft 105 through the cam chains 164 and 165. Then, the intake valves 147 and the exhaust valves 148 open and close the intake ports 145 and the exhaust ports 146 in accordance with the cam profiles of the camshafts 151 and 152 which rotate integrally with the driven sprocket wheels 161 and 162, respectively.

A generator not shown is provided at a left end portion of the crankshaft 105, and a driving gear wheel (hereinafter referred to as crank side driving gear wheel) 175 is secured to the inner side (left side of the vehicle body) of the right side driving sprocket wheel 163. This crank side driving gear wheel 175 meshes with a driven gear wheel (hereinafter referred to as intermediate side driven gear wheel) 177 provided on the intermediate shaft 121 and transmits rotation of the crankshaft 105 at an equal speed to the intermediate shaft 121 so that the intermediate shaft 121 is rotated at a speed equal to that of the crankshaft 105 but in the opposite direction.

The intermediate shaft 121 is supported for rotation at a position downwardly of the rear side of the crankshaft 105 and downwardly of the front side of the main shaft 123.

At a right end portion of the intermediate shaft 121, an oil pump driving sprocket wheel 181, the intermediate side driven gear wheel 177 and a driving gear wheel (hereinafter referred to as intermediate side driving gear wheel) 182 having a diameter smaller than that of the intermediate side driven gear wheel 177 are attached in order.

The oil pump driving sprocket wheel 181 transmits rotating force of the intermediate shaft 121 to a driven sprocket wheel 186, which is secured to a driving shaft 185 of an oil pump 184 disposed downwardly of the main shaft 123 on the rear side of the intermediate shaft 121, through a power transmission chain 187 to drive the oil pump 184.

Meanwhile, the intermediate side driving gear wheel 182 meshes with a driven gear wheel (hereinafter referred to as main side driven gear wheel) 191 provided for relative rotation on the main shaft 123 and transmits rotation of the intermediate shaft 121 at a reduced speed to the main shaft 123 through a clutch mechanism (not shown). In particular, the reduction ratio from the crankshaft 105 to the main shaft 123, that is, the primary reduction ratio of the engine 17, is set by the reduction ratio of the intermediate side driving gear wheel 182 and the main side driven gear wheel 191.

The main shaft 123 is supported for rotation upwardly of the rear side of the crankshaft 105, and the countershaft 125 is supported for rotation substantially rearwardly of the main shaft 123. Over the main shaft 123 and the countershaft 125, a speed change gear wheel group not shown is disposed, and a transmission is formed from them.

The countershaft 125 is connected at a left end portion thereof to a drive shaft (not shown) extending in the forward and backward direction of the vehicle body. Consequently, the rotation of the countershaft 125 is transmitted to the drive shaft.

Figure 4:
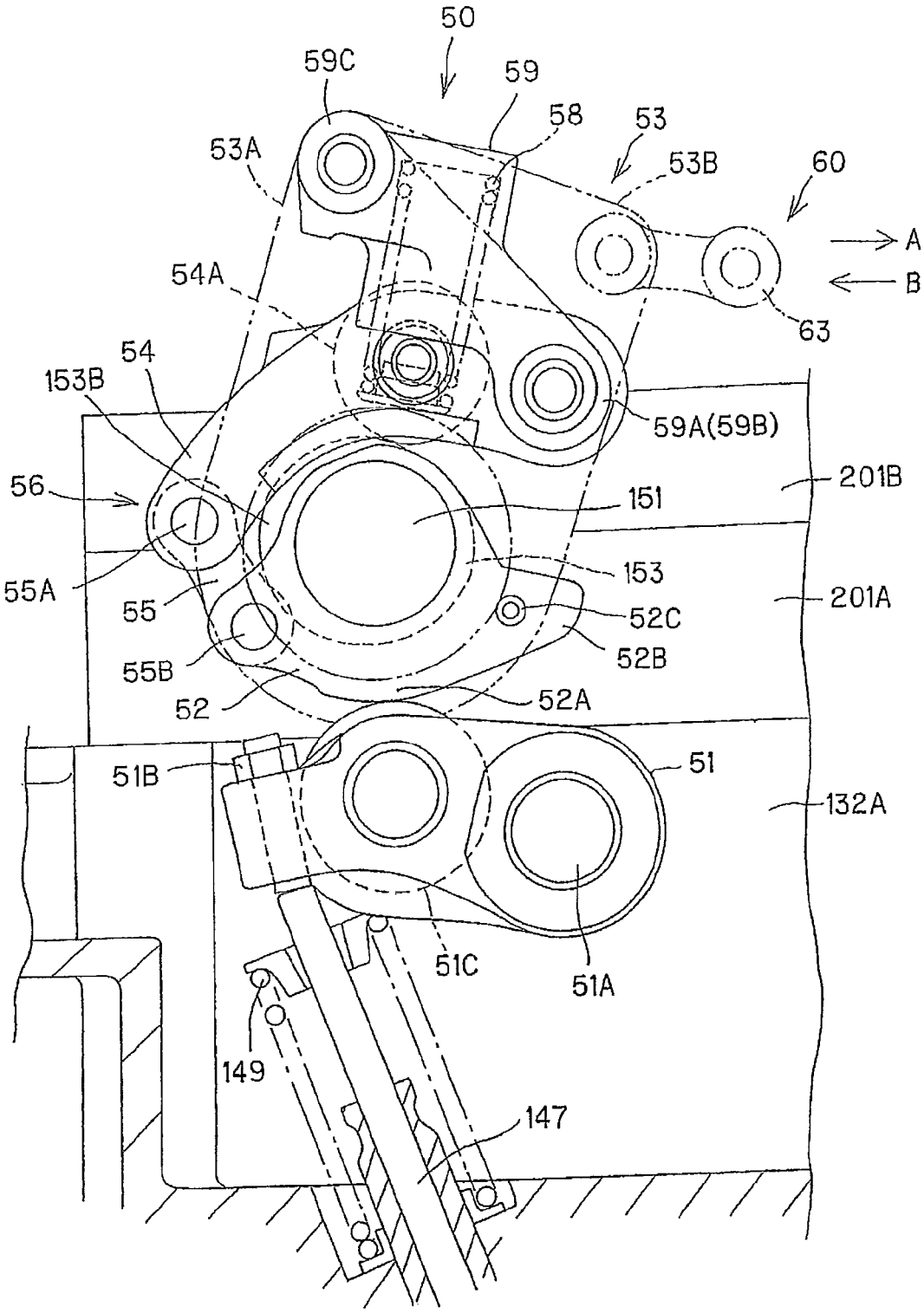
FIG. 4 is a side elevational view showing the valve motion.
Figure 5:
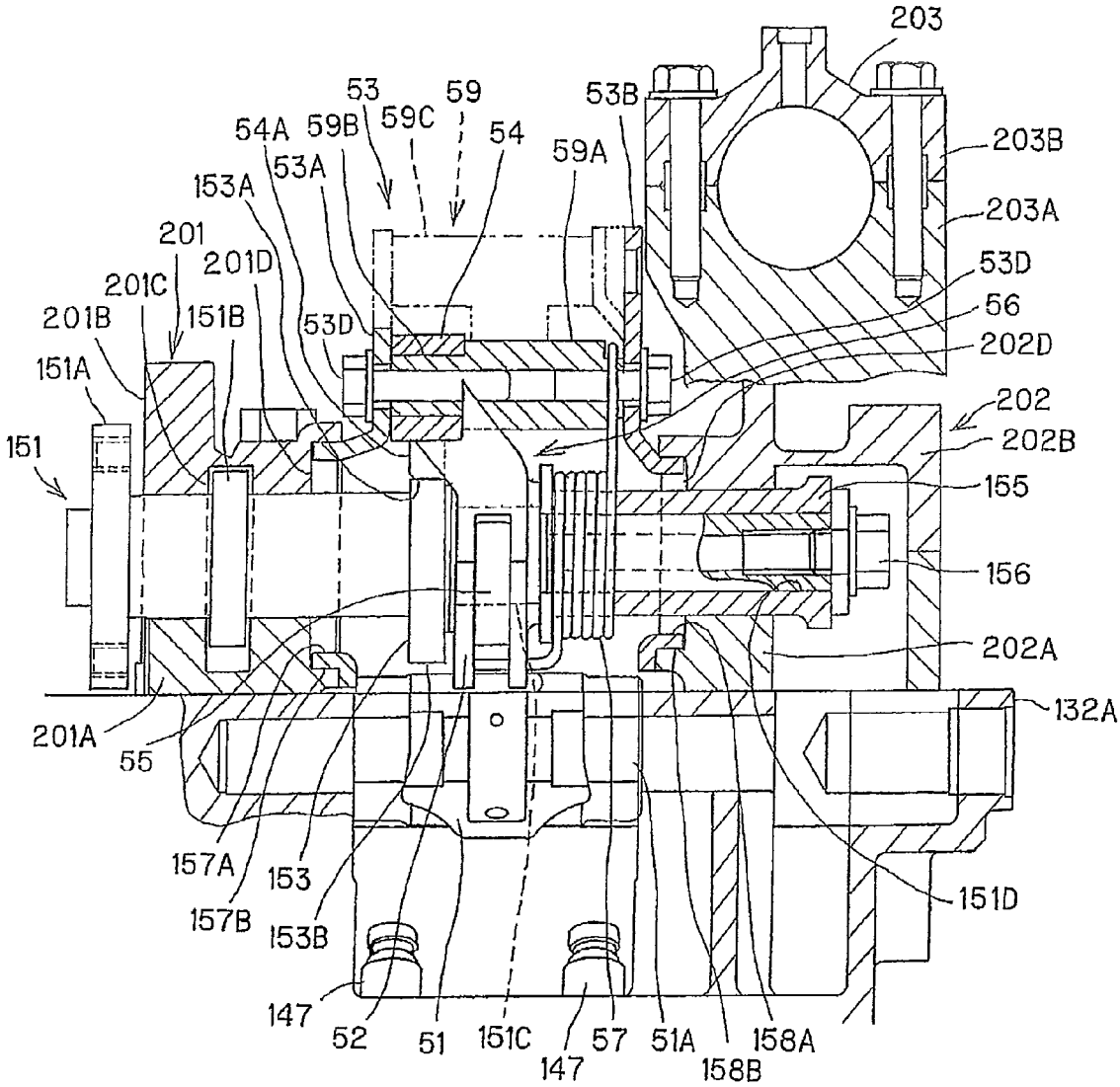
FIG. 5 is a vertical sectional view of the valve motion of the front bank as viewed from the rear side.

FIG. 4 is a side elevational view showing a valve motion 50, and FIG. 5 is a vertical sectional view of the valve motion 50 of the front bank 110A as viewed from the rear side.

As shown in FIG. 3, the valve motions 50 are provided independently for the intake side and the exhaust side and symmetrically with respect to the cylinder axial line C. Since the valve motions 50 of the front bank 110A and the rear bank 110B have a substantially the same structure, in the present embodiment, the valve motions 50 on the intake side of the front bank 110A are described.

As shown in FIGS. 4 and 5, each valve motion 50 includes the camshaft 151 (on the exhaust side, the camshaft 152), the intake cam 153 (on the exhaust side, the exhaust cam 154) which rotates integrally with the camshaft 151, a rocker arm 51 for opening and closing the intake valve 147 (on the exhaust side, an exhaust valve 148), a valve motion cam 52 supported for relative rotation on the camshaft 151 for opening and closing the intake valve 147 through the rocker arm 51, a holder (holder member) 53 rockable around the camshaft 151, a link mechanism 56 supported for rocking motion on the holder 53 for transmitting valve driving force of the intake cam 153 to the valve motion cam 52 so that the valve motion cam 52 is rocked, and a driving mechanism 60 for rocking the holder 53. Further, the link mechanism 56 includes a sub rocker arm 54 connected to the holder 53 and a connect link 55 for connecting the sub rocker arm 54 and the valve motion cam 52 for rocking motion to each other.

The rocker arm 51 is formed wide such that a pair of intake valves 147 are opened and closed by the single rocker arm 51. The rocker arm 51 is supported at one end portion thereof for rocking motion around a rocker arm pivot 51A secured to the cylinder head 132A. A pair of adjustment screws 51B which contact with upper end portions of the intake valves 147 is provided at the other end portion of the rocker arm 51, and a roller 51C for contacting with the valve motion cam 52 is supported for rotation at a central portion of the rocker arm 51.

As shown in FIG. 5, the camshaft 151 has, on one end side thereof, a sprocket wheel securing portion 151A to which the driven sprocket wheel 161 (refer to FIG. 2) is secured, and a positioning portion 151B projecting to an outer circumference of the camshaft 151 and having a circular cross section, a rocking cam supporting portion 151C for supporting the intake cam 153 and the valve motion cam 52 for rocking motion and a collar fitting portion 151D formed with a smaller diameter than that of the rocking cam supporting portion 151C are provided in order from the sprocket wheel securing portion 151A side on the camshaft 151. A camshaft collar 155 which functions as a bearing for the camshaft 151 is fitted on the collar fitting portion 151D. The camshaft collar 155 is pressed against the valve motion cam 52 side by a fixing bolt 156 fastened to the other end side of the camshaft 151.

The camshaft 151 is supported at the opposite ends thereof for rotation by camshaft supporting portions 201 and 202. In particular, the camshaft supporting portions 201 and 202 are formed such that caps 201B and 202B having supporting portions of a semicircular cross section are secured to head side supporting portions 201A and 202A formed at an upper portion of the front side cylinder head 132A. A groove 201C conforming to the shape of the positioning portion 151B is formed on the camshaft supporting portion 201 provided on the positioning portion 151B side, and the position of the positioning portion 151B is restricted by the groove 201C to position the camshaft 151 in the axial direction.

Further, on faces of the camshaft supporting portions 201 and 202 on the intake cams 153 side, holder supporting portions 201D and 202D for supporting the holder 53 are provided, respectively.

The valve motion cam 52 is disposed on the rocking cam supporting portion 151C provided at an intermediate portion of the camshaft 151. On the valve motion cam 52, a base circle portion 52A for keeping the intake valves 147 in a closed valve state and a cam lobe portion 52B for pushing down the intake valves 147 to open the intake valves 147 are foamed as seen in FIG. 4. A through-hole 52C is formed in the cam lobe portion 52B. To the through-hole 52C, one end of a valve motion cam return spring 57 (refer to FIG. 5) for biasing the valve motion cam 52 in a direction in which the cam lobe portion 52B is spaced away from the roller 51C of the rocker arm 51, that is, in a direction in which the intake valves 147 is closed, is attached. The valve motion cam return spring 57 is wrapped around the camshaft 151 as shown in FIG. 5 and is attached at the other end thereof to the holder 53.

The holder 53 includes first and second plates 53A and 53B disposed in a spaced relationship by a predetermined distance from each other in the axial direction of the camshaft 151 with the intake cams 153 and the valve motion cam 52 sandwiched therebetween, and a connecting member 59 for connecting the first and second plates 53A and 53B to each other in the axial direction of the camshaft 151. The first plate 53A is disposed on the one end side of the camshaft 151 to which the driven sprocket wheel 161 is secured, and the second plate 53B is disposed on the other end side of the camshaft 151.

Meanwhile, the connecting member 59 has a shaft portion 59A parallel to the camshaft 151, and a sub rocker arm supporting member 59B (fulcrum) to which one end of the sub rocker arm 54 is connected is formed at an end of the shaft portion 59A on the first plate 53A side. The connecting member 59 is secured to the first and second plates 53A and 53B by a pair of bolts 53D which are inserted into the opposite ends of the shaft portion 59A from the outer face sides of the first and second plates 53A and 53B. Further, the connecting member 59 has a shaft portion 59C parallel to the shaft portion 59A and is secured to the first and second plates 53A and 53B also by a pair of bolts (not shown) inserted in the opposite ends of the shaft portion 59C from the outer face sides of the first and second plates 53A and 53B.

Meanwhile, the first and second plates 53A and 53B have shaft holes 157A and 158A, respectively, through which the camshaft 151 extends. Circumferential edge portions of the shaft holes 157A and 158A form projections 157B and 158B projecting toward the holder supporting portions 201D and 202D, respectively. The holder 53 is supported by the projections 157B and 158B fitted in the holder supporting portions 201D and 202D and is rockable around the camshaft 151.

The sub rocker arm 54 is disposed between the first and second plates 53A and 53B together with the intake cam 153 and the valve motion cam 52, and is supported at one end portion thereof for pivotal motion around the sub rocker arm supporting member 59B of the connecting member 59 in such a manner as to rock around the sub rocker arm supporting member 59B. A roller 54A which contacts with the intake cam 153 is supported for rotation at a central portion of the sub rocker arm 54. To the other end portion of the sub rocker arm 54, the connect link 55 is connected at one end thereof through a pin 55A (refer to FIG. 4) which supports the connect link 55 for rocking motion. To the other end of the connect link 55, the valve motion cam 52 is connected through a pin 55B (refer to FIG. 4) which supports the valve motion cam 52 for rocking motion.

Further, as shown in FIG. 4, the sub rocker arm 54 is biased by a sub rocker arm return spring 58 accommodated in the connecting member 59 so that the roller 54A is normally pressed against the intake cam 153. Here, the sub rocker arm return spring 58 is a coil spring.

Now, the operation is described.

Referring to FIG. 4, in the valve motion 50 configured in such a manner as described above, when the camshaft 151 is rotated, the sub rocker arm 54 is pushed up through the roller 54A by the cam lobe portion 153B of the intake cam 153 which rotates integrally with the camshaft 151 so that it is rocked around the shaft portion 59A. Thereupon, the valve motion cam 52 is rotated clockwise in FIG. 4 around the camshaft 151 through the connect link 55. Then, by the rotation of the valve motion cam 52, the cam lobe portion 52B pushes down the intake valve 147 together with the rocker aim 51 through the roller 51C to open the intake valve 147. Further, in a state wherein the camshaft 151 is further rotated until the base circle portion 153A of the intake cam 153 contacts with the roller 54A, the sub rocker arm 54 is pushed down by the sub rocker arm return spring 58 and the valve motion cam 52 is rotated counterclockwise in FIG. 4 by the valve motion cam return spring 57 until the base circle portion 52A is contacted with the roller 51C. Consequently, the intake valve 147 is pushed up by the valve spring 149 (refer to FIG. 2) into a closed state.

In this valve motion 50, the connecting link member 63 is connected to the holder 53 as shown in FIG. 4. If the connecting link member 63 is moved in the direction indicated by an arrow mark A, then the holder 53 is rocked in the clockwise direction around the axis of the camshaft 151 to displace the sub rocker arm supporting member 59B downwardly in FIG. 4. On the other hand, if the sub rocker arm supporting member 59B moves in the direction indicated by an arrow mark B, the holder 53 is rocked in the counterclockwise direction around the axis of the camshaft 151 to displace the sub rocker arm supporting member 59B upwardly in FIG. 4.

Consequently, the valve motion 50 is configured such that it can change the operation characteristic in opening and closing of the intake valve 147 and the exhaust valve 148.

Figure 6:
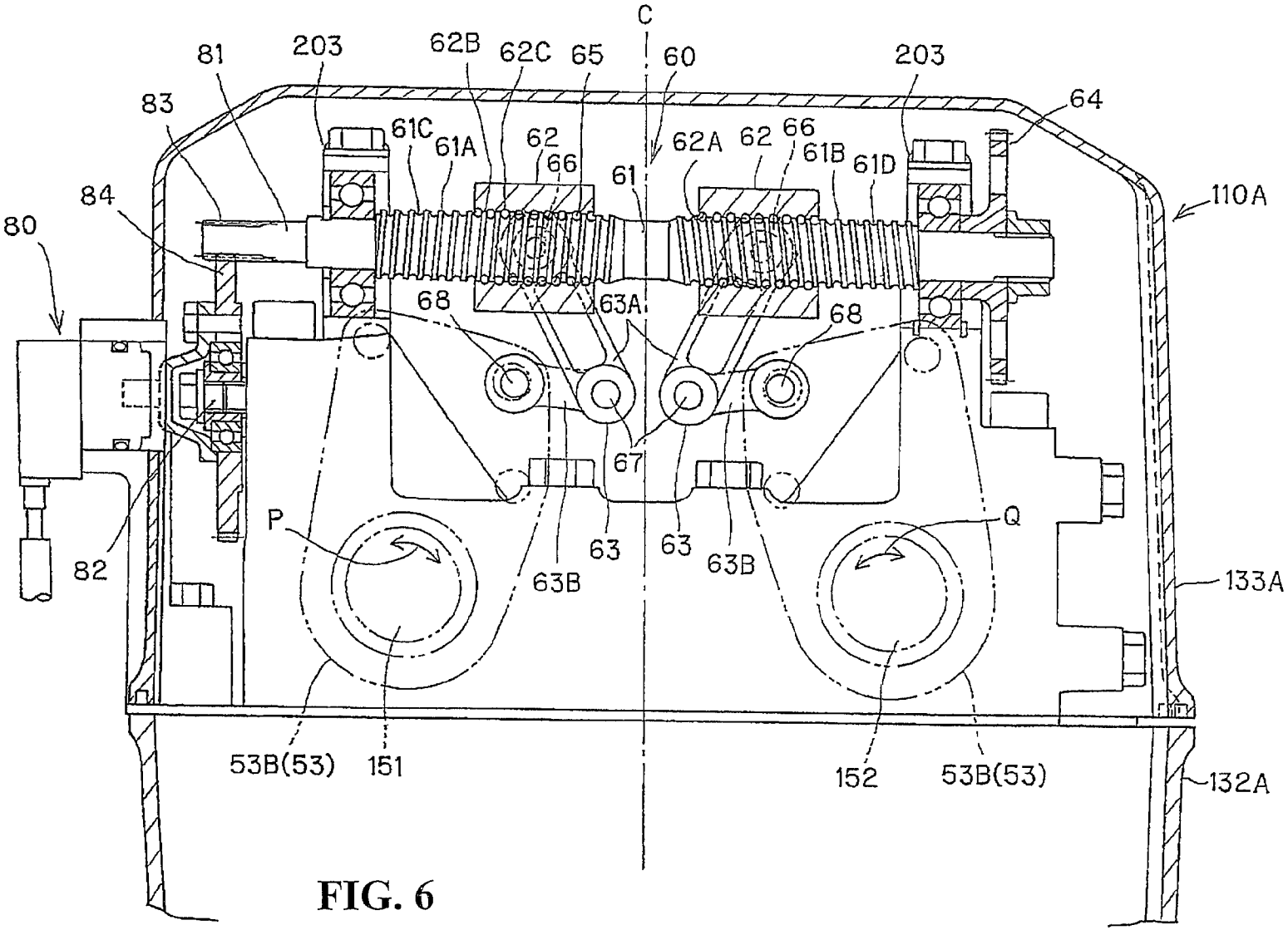
FIG. 6 is a vertical sectional view of a driving mechanism as viewed in side elevation.

The connecting link member 63 is connected to the driving mechanism 60 as shown in FIG. 6.

Figure 7:
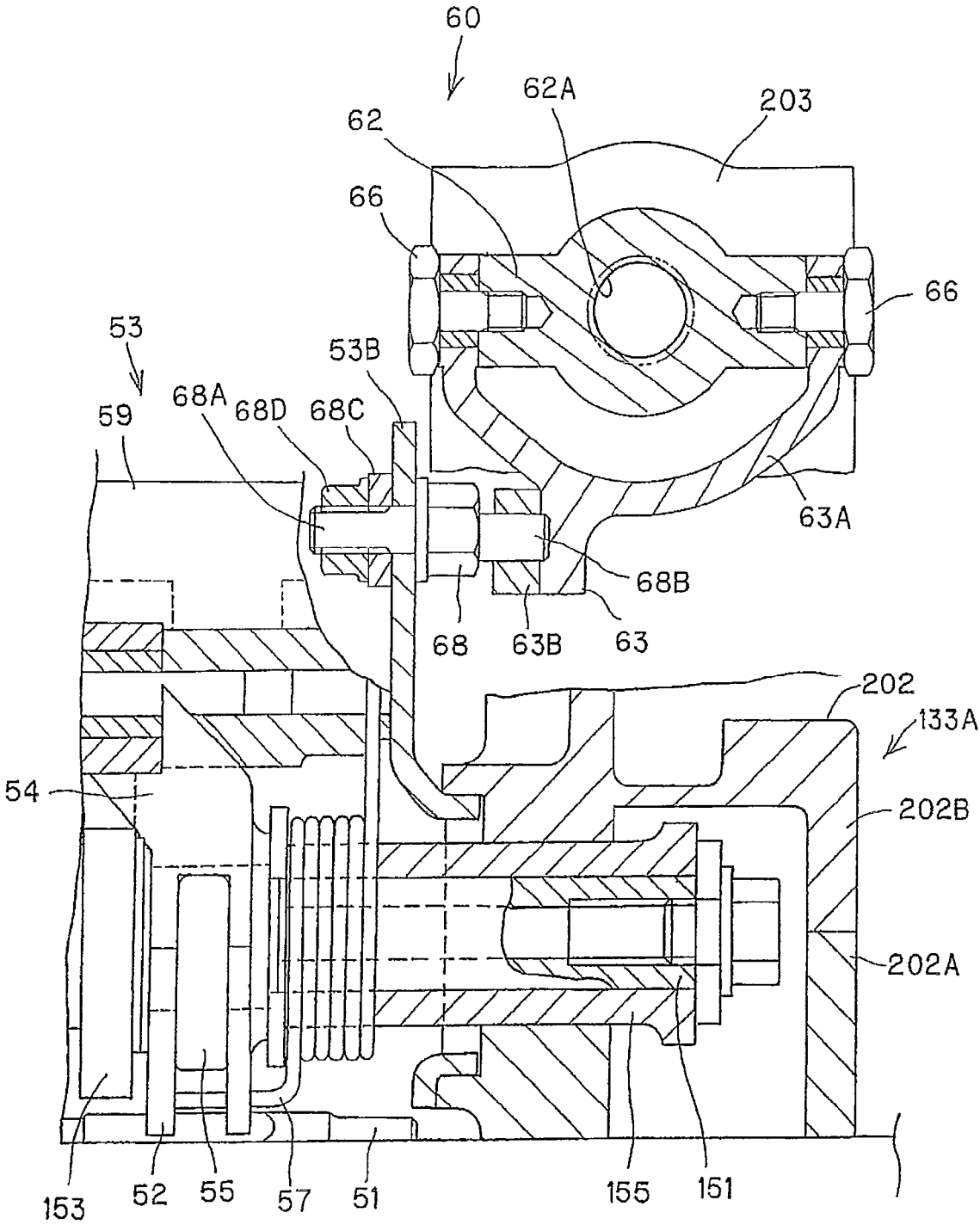
FIG. 7 is a vertical sectional view of the driving mechanism as viewed in front elevation.

FIG. 6 is a vertical sectional view of the driving mechanism 60 as viewed in side elevation, and FIG. 7 is a vertical sectional view of the driving mechanism 60 as viewed in a front elevation.

As shown in FIG. 6, the driving mechanism 60 is connected to the holder 53 through the connecting link member 63. The driving mechanism 60 includes a ball screw 61 disposed over the camshaft 151 and the camshaft 152, and two nuts (sliders) 62 individually provided for the intake side and the exhaust side and movable in an axial direction on the ball screw 61. The driving mechanism 60 is provided between the nuts 62 and the holder 53.

The ball screw 61 has a gear wheel 64 secured to one end portion thereof on the exhaust side, and an electric actuator (not shown) for rotating the ball screw 61 is connected to the gear wheel 64 by a gear wheel train.

The ball screw 61 is provided such that the axial line thereof extends substantially in parallel to the top face of the head cover 133A (133B). The ball screw 61 extends perpendicularly to the camshafts 151 and 152 and is disposed on the other end side of the camshafts 151 and 152, that is, on the opposite side to the side on which the driven sprocket wheels 161 and 162 (refer to FIG. 2) are secured. The ball screw 61 is supported at the opposite ends thereof individually by ball screw supporting portions 203. As shown in FIG. 5, the ball screw supporting portions 203 are provided such that a cap 203B having supporting portions of a semicircular cross section are secured to a camshaft side supporting 203A formed at an upper portion of the camshaft supporting portion 202.

As shown in FIG. 6, helical screw threads 61A and 61B and helical shaft thread grooves 61C and 61D are provided on the intake side and the exhaust side, respectively, on an outer circumferential face of the ball screw 61. The screw threads 61A and 61B and the shaft thread grooves 61C and 61D form threaded portions. The screw threads 61A and 61B and the shaft thread grooves 61C and 61D have directions of helix set different from each other between the intake side and the exhaust side. The threaded portions 61A to 61D are formed at a position sandwiched by the intake cam 153 (refer to FIG. 3) (camshaft 151) and the exhaust cam 154 (refer to FIG. 3) (camshaft 152).

A sensor 80 for detecting the rotation of the ball screw 61 is provided at the other end portion on the intake side of the ball screw 61. The sensor 80 is secured to a wall portion of the head cover 133A (133B) on the side positioned on the inner side of the V banks. Since the sensor 80 is disposed on the inner side of the V banks in this manner, it becomes possible to reduce the length of the engine 17 in the forward and backward direction of the vehicle body and surround the periphery of the sensor 80 with the front bank 110A and the rear bank 110B (refer to FIG. 2).

The sensor 80 includes a rotary shaft 81 secured to the other end portion of the ball screw 61, and a fixed shaft 82 disposed downwardly of and substantially in parallel to the rotary shaft 81 and formed from a hexagon socket screw secured to the ball screw supporting portion 203. A driving gear wheel 83 is formed on an outer circumferential face of the rotary shaft 81, and a driven gear wheel 84 which meshes with the driving gear wheel 83 is formed on the fixed shaft 82. Accordingly, if the ball screw 61 rotates, then rotation of the rotary shaft 81 which rotates integrally with the ball screw 61 is transmitted to the driven gear wheel 84 through the driving gear wheel 83. The sensor 80 detects the amount of rotation of the ball screw 61 from the amount of rotation of the driven gear wheel 84.

The nuts 62 have a through-hole 62A through which the ball screw 61 extends, and helical nut screw threads 62B corresponding to the screw threads 61A and 61B and helical nut thread grooves 62C corresponding to the shaft thread grooves 61C and 61D are formed on an inner circumferential face of the through-hole 62A. A plurality of balls 65 which can roll are disposed between the nut thread grooves 62C and the shaft thread grooves 61C and 61D. When the ball screw 61 rotates, the nuts 62 move on the ball screw 61 through the balls 65.

As shown in FIGS. 6 and 7, each connecting link member 63 includes a nut side link (link member) 63A secured at one end portion thereof to the nut 62 and a holder side link (link member) 63B for connecting the other end portion of the nut side link 63A and the second plate 53B to each other.

The nut side link 63A sandwiches, at one end portion thereof, the nut 62 from the opposite sides and is secured to the nut 62 by a bolt (slider side connection portion) 66. The nut side link 63A is supported at the other end portion thereof for rocking motion at one end portion of the holder side link 63B by a pin (connecting portion) 67. The holder side link 63B is supported at the other end portion thereof for rocking motion on the second plate 53B by an eccentric pin (holder side connection portion) 68. The pin 67 is positioned on the cylinder axial line C side with respect to the bolt 66 and the eccentric pin 68. The eccentric pin 68 includes a hexagon head bolt 68A and an eccentric shaft 68 formed integrally and eccentrically at a head portion of the hexagon head bolt 68A. The hexagon head bolt 68A is secured to the second plate 53B by a spring washer 68C and a hexagon head nut 68D, and the eccentric shaft 68 is supported for rotation on the nut side link 63A.

Referring to FIG. 6, if the holders 53 rock in the directions indicated by arrow marks P and Q, then the position of the sub rocker arm supporting member 59B of each of the link mechanisms 56 shown in FIG. 4 is varied. As the position of the sub rocker arm supporting member 59B is varied, the valve motion cam 52 rocks around the camshaft 151 to change the position thereof in a circumferential direction with respect to the camshaft 151 to change the phase thereof in the circumferential direction with respect to the intake cam 153, here to change the angular position or circumferential position thereof. Since the period within which the cam lobe portion 52B contacts with the roller 51C and the amount by which the cam lobe portion 52B pushes down the roller 51C can be changed by the change of the position of the valve motion cam 52 in the circumferential direction with respect to the intake cam 153 in this manner, the valve opening period and the lift amount of the intake valve 147 can be changed.

For example, if the ball screw 61 rotates to move the nuts 62 toward the center side of the ball screw 61 and the holder 53 is further rocked in the clockwise direction in FIG. 4 by the holder 53, then the valve motion cam 52 is rotated in the clockwise direction by the link mechanism 56. If the camshaft 151 is rotated in this state, then the period for which the cam lobe portion 52B pushes down the roller 51C and the pushing down amount then increase, and the valve opening period and the lift amount of the intake valves 147 increase.

As shown in FIG. 6, since the ball screw 61 does not extend in the upward and downward direction of the engine 17 but is disposed substantially in parallel to the top face of the head cover 133A (133B) over the camshaft 151 or the camshaft 152, the height of the engine 17 can be suppressed low in comparison with an alternative case wherein the ball screw extends in the upward and downward direction.

Further, since the threaded portions 61A to 61D having different directions between the intake side and the exhaust side are provided on the ball screw 61 and the nuts 62 which are movable on the ball screw 61 are provided on both of the intake side and the exhaust side of the ball screw 61, even if the distance between the camshafts 151 and 152 in each valve motion 50 of the DOHC type becomes long, the length of the connecting link member 63 for connecting the nut 62 and the holder 53 can be suppressed short in comparison with an alternative case wherein the nut is provided at a substantially central location between the camshafts 151 and 152. As a result, it can be prevented that the range of pivotal motion of the holder 53 with respect to the amount of movement of the connecting link member 63 decreases as the connecting link member 63 becomes long. Further, since the ball screw 61 for moving the nuts 62 on the intake side and the exhaust side is not divided into portions for the intake side and the exhaust side but is formed as a common part, the number of parts can be reduced.

Since the threaded portions 61A to 61D of the ball screw 61 are formed at a position sandwiched between the intake cams 153 and the exhaust cams 154, the width of the cylinder heads 132A and 132B can be reduced by moving the ball screw 61 between the intake cam 153 and the exhaust cam 154 through the nuts 62.

The connecting link member 63 includes two links of the nut side link 63A and the holder side link 63B, and the pins 67 which connect the nut side link 63A and the holder side link 63B are positioned on the cylinder axial line C side with respect to the bolts 66 which connect the nut side links 63A and the nuts 62 to each other and the eccentric pins 68 which connect the holder side links 63B and the holders 53. Consequently, it becomes possible to dispose the ball screw 61 and the holders 53 more closely to each other, and it becomes possible to reduce the height of the cylinder heads 132A and 132B.

The second plates 53B and the nut side links 63A sometimes suffer from a production error, an assembly error and so forth of parts, and it is sometimes difficult to connect the second plates 53B and the nut side links 63A to each other.

In the present embodiment, since each eccentric pin 68 is used as a pivot for the nut side link 63A for connecting the second plate 53B and the nut side link 63A to each other, production errors of parts are absorbed and positional adjustment of the parts is facilitated by changing the attachment angle of the eccentric pin 68 to the second plate 53B. As a result, it becomes easy to connect the second plate 53B and the nut side link 63A.

As described above, according to the present embodiment, since the ball screw 61 for moving the nuts 62 is disposed over the camshaft 151 and the camshaft 152, the height of the engine 17 can be suppressed low in comparison with an alternative case wherein the ball screw extends in an upward and downward direction of the engine. Further, since the threaded portions 61A to 61D having directions different from each other on the intake side and the exhaust side are provided on the ball screw 61 and the nuts 62 movable on the ball screw 61 are provided on the intake side and the exhaust side of the ball screw 61, even if the distance between the camshafts 151 and 152 in each valve motion 50 of the DOHC type increases, the length of the connecting link members 63 for connecting the nuts 62 and the holder 53 can be suppressed short in comparison with an alternative case wherein a nut is provided at a substantially central position between the camshafts 151 and 152. As a result, the holder 53 can be pivoted without narrowing the range of pivotal motion thereof.

Further, with the embodiment described above, since the threaded portions 61A to 61D of the ball screw 61 are formed at positions sandwiched between the intake cam 153 and the exhaust cam 154, the nuts 62 move on the ball screw 61 between the intake cam 153 and the exhaust cam 154. Consequently, the width of the cylinder heads 132A and 132B can be reduced. Further, since the connecting link member 63 includes two links of the two nut side link 63A and holder side link 63B connected for pivotal motion to each other and the pin 67 for connecting the two nut side link 63A and holder side link 63B is positioned on the cylinder axial line C side with respect to the bolts 66 for connecting the nut side links 63A and the nuts 62 to each other and the eccentric pins 68 for connecting the holder side links 63B and the holders 53, it is possible to dispose the ball screw 61 and the holders 53 more closely to each other. Therefore, the height of the cylinder heads 132A and 132B can be reduced.

Further, with the embodiment described above, since one of the pivots of the connecting link member 63 is connected by the eccentric pin 68, production errors of parts are absorbed by the eccentric pin 68. Consequently, the positional adjustment of the parts can be carried out readily.

However, the embodiment described above is one mode of the present invention and can naturally be modified suitably without departing from the subject matter of the present invention.

For example, while, in the embodiment described above, the sensor 80 is provided on both of the banks 110A and 110B, it may otherwise be provided on one of the banks 110A and 110B.

Further, while, in the embodiment described above, the eccentric pin 68 is used for the pivot of the nut side link 63A which connects the holder 53 and the nut side link 63A to each other, the present invention is not limited to this, and an eccentric pin structure may be adopted for a connecting portion of the connecting link member 63, that is, for the pin 67 and the bolt 66.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. A valve motion for an internal combustion engine which includes a camshaft which rotates in synchronism with rotation of said internal combustion engine, a driving cam which rotates integrally with said camshaft, a valve motion cam which makes relative rotation to said camshaft to open and close an engine valve, a link mechanism for transmitting valve driving force of said driving cam to said valve motion cam, a holder member which supports a fulcrum of said link mechanism thereon and is rockable around said camshaft, and a driving mechanism for rocking said holder member to vary the position of the fulcrum of said link mechanism and wherein a valve operation wherein in accordance with which said engine valve opens and closes can be changed by the rocked position of the fulcrum of said link mechanism, comprising:

said driving mechanism includes a ball screw disposed over an intake side camshaft and an exhaust side camshaft and having threaded portions provided thereon which are threaded in different directions from each other on the intake side and the exhaust side, sliders individually provided on the intake side and exhaust side and movable on said ball screw, and connecting link members provided between said sliders and said holder member.

2. The valve motion for the internal combustion engine according to claim 1, wherein said threaded portions of said ball screw are formed at positions sandwiched by an intake side driving cam and an exhaust side driving cam and said connecting link members includes two link members connected for pivotal motion, and connecting portions of said two link members are positioned on the cylinder center side with respect to a slider side connecting portion and a holder member side connecting portion.

3. The valve motion for the internal combustion engine according to claim 2, wherein said connecting link member is connected at one of pivots thereof by an eccentric pin.

4. The valve motion for the internal combustion engine according to claim 1, wherein said connecting link member is connected at one of pivots thereof by an eccentric pin.

5. The valve motion for the internal combustion engine according to claim 1, wherein the connecting link member includes two links of a nut side link and a holder side link, and pins which connect the nut side link and the holder side link are positioned on a cylinder axial line side with respect to bolts for connecting the nut side links.

6. The valve motion for the internal combustion engine according to claim 5, wherein nuts and eccentric pins are provided for connecting the holder side links and holder members.

7. The valve motion for the internal combustion engine according to claim 6, wherein the ball screw and the holders are position close to each other for reducing the height of cylinder heads.

8. The valve motion for the internal combustion engine according to claim 1, wherein the ball screw for moving nuts is disposed over the camshaft for suppressing the height of the engine as compared with a ball screw extending in an upward and downward direction of the engine.

9. The valve motion for the internal combustion engine according to claim 8, wherein the threaded portions having directions different from each other on the intake side and the exhaust side are provided on the ball screw and the nuts movable on the ball screw are provided on the intake side and the exhaust side of the ball screw, even if the distance between the camshafts in each valve motion increase.

10. The valve motion for the internal combustion engine according to claim 9, wherein the length of the connecting link members for connecting the nuts and the holder are suppressed short in comparison with an alternative case wherein a nut is provided at a substantially central position between the camshafts wherein the holder is pivoted without narrowing the range of pivotal motion thereof.

11. A valve motion for an internal combustion engine comprising:

a camshaft for rotating in synchronism with a rotation of the internal combustion engine;

a driving cam for rotating integrally with the camshaft;

a valve motion cam for rotation relative to said camshaft for opening and closing an engine valve;

a link mechanism for transmitting a valve driving force of said driving cam to said valve motion cam;

a holder member for supporting a fulcrum of said link mechanism thereon, said holder member being rockable around said camshaft;

a driving mechanism for rocking said holder member to vary the position of the fulcrum of said link mechanism;

wherein a valve operation in accordance with the opening and closing of said engine valve is changed by the rocked position of the fulcrum of said link mechanism;

a ball screw being operatively included in said driving mechanism and being disposed over an intake side camshaft and an exhaust side camshaft and having threaded portions provided thereon which are threaded in different directions from each other on the intake side and the exhaust side;

sliders individually provided on the intake side and exhaust side and movable on said ball screw; and connecting link members provided between said sliders and said holder member.

12. The valve motion for the internal combustion engine according to claim 11, wherein said threaded portions of said ball screw are formed at positions sandwiched by an intake side driving cam and an exhaust side driving cam and said connecting link member includes two link members connected for pivotal motion, and connecting portions of said two link members are positioned on the cylinder center side with respect to a slider side connecting portion and a holder member side connecting portion.

13. The valve motion for the internal combustion engine according to claim 12, wherein said connecting link member is connected at one of pivots thereof by an eccentric pin.

14. The valve motion for the internal combustion engine according to claim 11, wherein said connecting link member is connected at one of pivots thereof by an eccentric pin.

15. The valve motion for the internal combustion engine according to claim 11, wherein the connecting link member includes two links of a nut side link and a holder side link, and pins which connect the nut side link and the holder side link are positioned on a cylinder axial line side with respect to bolts for connecting the nut side links.

16. The valve motion for the internal combustion engine according to claim 15, wherein the nuts and eccentric pins 68 are provided for connecting the holder side links and the holders.

17. The valve motion for the internal combustion engine according to claim 16, wherein the ball screw and the holders are position close to each other for reducing the height of cylinder heads.

18. The valve motion for the internal combustion engine according to claim 11, wherein the ball screw for moving nuts is disposed over the camshaft for suppressing the height of the engine as compared with a ball screw extending in an upward and downward direction of the engine.

19. The valve motion for the internal combustion engine according to claim 18, wherein the threaded portions having directions different from each other on the intake side and the exhaust side are provided on the ball screw and the nuts movable on the ball screw are provided on the intake side and the exhaust side of the ball screw, even if the distance between the camshafts in each valve motion increase.

20. The valve motion for the internal combustion engine according to claim 19, wherein the length of the connecting link members for connecting the nuts and the holder are suppressed short in comparison with an alternative case wherein a nut is provided at a substantially central position between the camshafts wherein the holder is pivoted without narrowing the range of pivotal motion thereof.

* * * * *